US005336332A

United States Patent [19]

Satoh et al.

[11] Patent Number: 5,336,332

[45] Date of Patent: Aug. 9, 1994

[54] WASHING APPARATUS AND METHOD FOR FLUIDIZED BED PELLETIZING AND DRYING MACHINE

[75] Inventors: Katsuhiko Satoh, Kawanishi; Itsuo Muto, Shijyonawate; Shigeki Takeda, Takaishi; Mamoru Miyamoto, Itami, all of Japan

[73] Assignees: Kabushiki Kaisha Powrex, Osaka; Kabushiki Kaisha Ariwa Seisakusho, Takarazuka, both of Japan

[21] Appl. No.: 757,403

[22] Filed: Sep. 10, 1991

[30] Foreign Application Priority Data

Jun. 26, 1991 [JP] Japan ..... 3-154228

[51] Int. Cl.[5] ..... B08B 3/02

[52] U.S. Cl. ..... 134/22.1; 134/22.18; 134/34; 134/55; 134/167 R

[58] Field of Search ..... 134/22.1, 22.11, 34, 134/44, 53, 167 R, 55

[56] References Cited

U.S. PATENT DOCUMENTS 3,721,608 3/1973 Saller et al. ..... 134/22
4,218,265 8/1980 Fuchs et al. ..... 134/22.11
4,553,558 11/1985 Hamazaki et al. .
4,716,917 1/1988 Schmidt .
5,017,241 5/1991 Ryan ..... 134/34
5,114,596 5/1992 Laterra ..... 134/22.12
5,135,580 8/1992 Cantrell et al. ..... 134/24

FOREIGN PATENT DOCUMENTS 60-176240 11/1985 Japan .
1080288 8/1967 United Kingdom .

*Primary Examiner*—Anthony McFarlane
*Attorney, Agent, or Firm*—Nikaido, Marmelstein, Murray & Oram

[57] ABSTRACT

Means is disclosed for washing the inside of a pelletizing machine containing a bag filter which is capable of being raised and lowered within the body of the machine. A vertically movable, upright means to spray washing liquid in three dimensions is provided above the bag filter. A horizontally movable spraying means is provided below the bag filter. This horizontal spraying means can be retracted from inside the pelletizing machine during pelletizing operations, but is capable of spraying washing liquid upwardly into the open end of the bag filter during washing operations.

3 Claims, 8 Drawing Sheets

WASHING APPARATUS AND METHOD FOR FLUIDIZED BED PELLETIZING AND DRYING MACHINE

BACKGROUND OF THE INVENTION

The present invention relates to a washing apparatus for a fluidized bed pelletizing and drying machine, capable of simultaneously washing a bag filter and the inner surface of the body of the fluidized bed pelletizing and drying machine.

As shown in FIG. 7, solid particles 65 stacked on a sintered metal net unit 64 installed at the lower end of a product container 63 are sprayed with a binder liquid or coating liquid from a nozzle 66 for pelletization or coating while they are fluidized by a fluidizing gas 62 introduced from the bottom section 61 of a fluidized bed pelletizing and drying machine 60 which is closed.

The gas 67 used for fluidization moves up in the body 69 as a gas containing fine solid particles. After having its solid particles removed by a bag filter 70 disposed in the upper region, the gas is discharged as the spent gas 72 from an exhaust duct 71. The bag filter 70 comprises a filter body 68 in the form of a bowl turned bottom upward, filter elements 73 projecting in the form of bottomed socks and disposed in concentric circles in the filter body 68, and a substantially cylindrical skirt portion 74 downwardly extending from the filter body 68. During treatment of powder particles, the bag filter is kept hoisted to the upper region of the body 69 by a wire 76 connected to a winch 75. Further, during treatment of powder particles, a seal tube 77 mounted on the inner surface of the body 69 closely contacts the skirt portion 74. Therefore, the bag filter 70 is held in the sealed state in the body 69 during said treatment.

When it is desired to wash the fluidized bed pelletizing and washing machine 60 first, the product container 63 and nozzle 66 are removed and then the fluid is discharged from the seal tube 77 to allow the bag filter 70 collapse. Subsequently, lowering and raising means 75 is driven to lower the bag filter 70, whereupon the latter is taken out and inner surface of the body 69 and the bag filter 70 are separately washed. However, with such washing method used, the bag filter 70 has to be taken outside the body 69, a fact which means that dust of particles stuck to the inner and outer surfaces of the bag filter 70 is scattered outside the body, and since the body 68 and the bag filter 70 are separately washed, the washing load is high, decreasing the washing efficiency. Further, since the removal of the bag filter has to be manually effected, full automation of washing operation is difficult to realize.

To solve such problem, for example, a washing apparatus as shown in Japanese Utility Model Application No. 62395/1984 is suggested. This washing apparatus, as shown in FIG. 8, is constructed by adding the following technical means to the washing apparatus described above: Upper and lower washing water spouting nozzles 78 and 79 are disposed above and below a vertically movable bag filter 70. The upper nozzle 78 is vertically movable by lifting means 80, while the lower nozzle 79 is fixed below a sintered metal net unit 64.

In the washing apparatus of such arrangement, upon completion of the treatment of powder particles, the bag filter 70 is lowered until it is close to the lower nozzle 79, while the upper nozzle 78 is lowered until it is close to the upper surface of the bag filter 70 now lowered. Then, washing water is spouted from the upper and lower nozzles 78 and 79 to wash the bag filter 70 and the inner surface of the body 69.

Such washing operation makes it possible to simultaneously wash the bag filter 70 and the inner surface of the body 69 without removing the bag filter 70 from inside the body 69. Therefore, there is no possibility of dust being scattered during the washing of the bag filter 70, and the washing load is light, increasing the washing efficiency. Further, by making the lifting means for the bag filter 70 and upper nozzle 78 in the form of an automatic lifting device and automatically controlling the supply of washing water to the upper and lower nozzles 78 and 79, it becomes possible to completely automate the washing operation on the bag filter 70 and the inner surface of the body 69; this will also enhance automation of the factory.

The washing apparatus described in Japanese Utility Model Application No. 62395 mentioned above has the following problems.

(1) Since the range of washing water spouting from the upper and lower nozzles is limited, it is difficult to uniformly wash every area. Further, the washing liquid hardly reach the inner surface of the filter elements in the form of bottomed socks; thus, the washing is liable to be insufficient.

(2) Since the upper nozzle is in the lowered position during washing, the washing of the inner surface of the portion of the body above the upper nozzle is insufficient.

(3) Since the lower nozzle is disposed below the sintered metal net unit, the washing liquid spouted from the lower nozzle reaches the areas to be washed only after it passes through the sintered metal net unit. This means that the washing water pressure at the areas to be washed is decreased and hence the washing of the inner surface of the body and the inner surface of the bag filter effected by the lower nozzle is insufficient. In addition, if the sintered metal net unit is removed prior to washing, such problem can be solved. In this case, however, attachment and detachment of the sintered metal net unit have to be manually effected, making it difficult to completely automate the washing operation.

The present invention, accomplished with the above in mind, is intended to provide a washing apparatus for a fluidized bed pelletizing and drying machine which is capable of simultaneously washing the bag filter and the inner surface of the body without removing the bag filter from inside the body, achieving complete automation of the washing operation and which solves the problems (1) through (3) described above so as to ensure reliable washing of areas to be washed.

SUMMARY OF THE INVENTION

The present invention provides a washing apparatus for a fluidized bed pelletizing and drying machine which includes a cylindrical body in which is housed a vertically movable bag filter comprising filter elements in the form of bottomed socks disposed in concentric circles, a bottom section, comprising a bottom container, slide guide means and associated parts, disposed in the lower region of said body, and a product container removably installed between said body and said sea t container, said washing apparatus being characterized in that the washing apparatus comprises an upright three-dimensional rotary nozzle unit capable of vertically moving in a space above said bag filter, a horizontal three-dimensional rotary nozzle unit capable of horizontally advancing and retracting between a position in the body below the uppermost position of the bag filter and a position outside the body, and a washing container in which is disposed a multiple two-dimensional horizontal rotary nozzle unit adapted to spout washing liquid from below toward the inner surface of the bag filter, wherein said washing container can be attached and detached between said body and said bottom section, and said washing container and said product container are selectively mounted between said body and said bottom section such that during washing the washing container is selected and during treatment of powder particles the product container is selected.

The multiple two-dimensional horizontal rotary nozzle unit comprises a nozzle header rotatable in a horizontal plane and a plurality of spout nozzles mounted on said nozzle header. The center of rotation of said nozzle header coincides with the center of the concentric circles defined by the filter elements of the bag filter, and the radii of rotation of the spout nozzles are determined to correspond to the radii of the concentric circles.

When the bag filter is set at its upper position, the washing liquid is spouted from the upright and horizontal three-dimensional rotary nozzle units to effect washing and upon completion of washing, the washing container is mounted in place of the product container between the body and the bottom section; subsequently to the movement of the horizontal three-dimensional rotary nozzle unit to the outside of the body, the bag filter and the upright three-dimensional rotary nozzle unit are lowered; when the bag filter reaches its lower position, the washing liquid is spouted from the upright three dimensional rotary nozzle unit and multiple two-dimensional horizontal rotary nozzle unit to effect washing and upon completion of washing, the product container is mounted again in place of the washing container between the body and the bottom section; after the upright three-dimensional rotary nozzle unit and bag filter are returned to their upper positions, hot air drying operation is performed.

When the bag filter is lifted, the washing liquid is spouted from the upright and horizontal three-dimensional rotary nozzle units. The upright three-dimensional rotary nozzle unit washes the upper region of the inner surface of the body and the outer surface of the bag filter while the horizontal three-dimensional rotary nozzle unit washes the lower region of the inner surface of the body and the inner surface of the bag filter. At this time, since the two nozzle units spout the washing liquid at the sufficient washing pressure randomly in three-dimensional directions, the areas to be washed are washed uniformly and reliably. When the bag filter is lowered, the washing container is mounted between the body and the bottom section, and the multiple two-dimensional horizontal rotary nozzle unit disposed in said washing container and the upright three-dimensional rotary nozzle unit which is lowered with the bag filter spout the washing liquid. At this time, the multiple two-dimensional horizontal rotary nozzle unit reliably washes the inner surface of the bag filter which is particularly difficult to wash. As a result, the inner surface of the body and the inner and outer surfaces of the bag filter are uniformly and reliably washed.

Further, filter elements in the form of bottomed socks are disposed in concentric circles to define the bag filter, while the center of rotation of the multiple two-dimensional horizontal rotary nozzle unit is positioned on the axis at the center of said concentric circles, and the spouting nozzles are mounted on a nozzle header such that they have the same radii of rotation as the radii of the concentric circles, thereby constructing the multiple two-dimensional horizontal rotary nozzle unit. As a result, the washing liquid spouted from the spout nozzles reaches the deepest regions of the inner surfaces of the filter elements; thus, the inner surface of the bag filter which has heretofore been difficult to wash can now be reliably washed.

The washing operation is performed in the following manner: First, when the bag filter is set at its upper position, the washing liquid is spouted from the upright and horizontal three-dimensional rotary nozzle units to wash the inner surface of the body and the inner surface of the bag filter. Upon completion of washing by the two units, the product container is removed and the washing container is mounted between the body and the bottom section. Further, after the horizontal three-dimensional rotary nozzle unit is moved to the outside of the body, the bag filter and the upright three-dimensional rotary nozzle unit are lowered. When the bag filter reaches its lower position, the washing liquid is spouted from the upright three-dimensional rotary nozzle unit and the multiple two-dimensional horizontal rotary nozzle unit to wash the inner surface of the body and the inner surface of the bag filter. At this time, the inner surface of the bag filter which is particularly difficult to wash is reliably washed by the multiple two-dimensional horizontal rotary nozzle unit. Upon completion of washing by the two units, the washing container is removed and the product container is mounted between the body and the seat container and the upright three-dimensional rotary nozzle unit and bag filter are returned to their upper positions. In this state, washing is performed once more and then hot air drying is performed to complete the washing operation.

By the invention described above, the bag filter and the inner surface of the body can be simultaneously washed without taking the bag filter out of the fluidized bed pelletizing and drying machine. Therefore, no dust is scattered outside during washing, and since the work load during washing is can be decreased, the washing efficiency can be greatly increased. Further, the possibility of complete automation of the washing operation contributes much to labor saving, cost reduction and increased and enhances the washing effect and stability of washing quality. Therefore, even if medicines or foods are treated after washing, contamination or the lowering of quality of powder particles which is attributable to incomplete washing can hardly take place. And it has been found that such completely automated washing operation is capable of uniformly and reliably washing various areas of a fluidized bed pelletizing and drying machine. Particularly, the inner surface of the bag filter which has heretofore been difficult to wash can be reliably washed.

DESCRIPTION OF THE PREFERRED EMBODIMENTS

An embodiment of a washing apparatus for a fluidized bed pelletizing and drying machine according to the present invention will now be described with reference to FIGS. 1 through 6.

Figure 1:
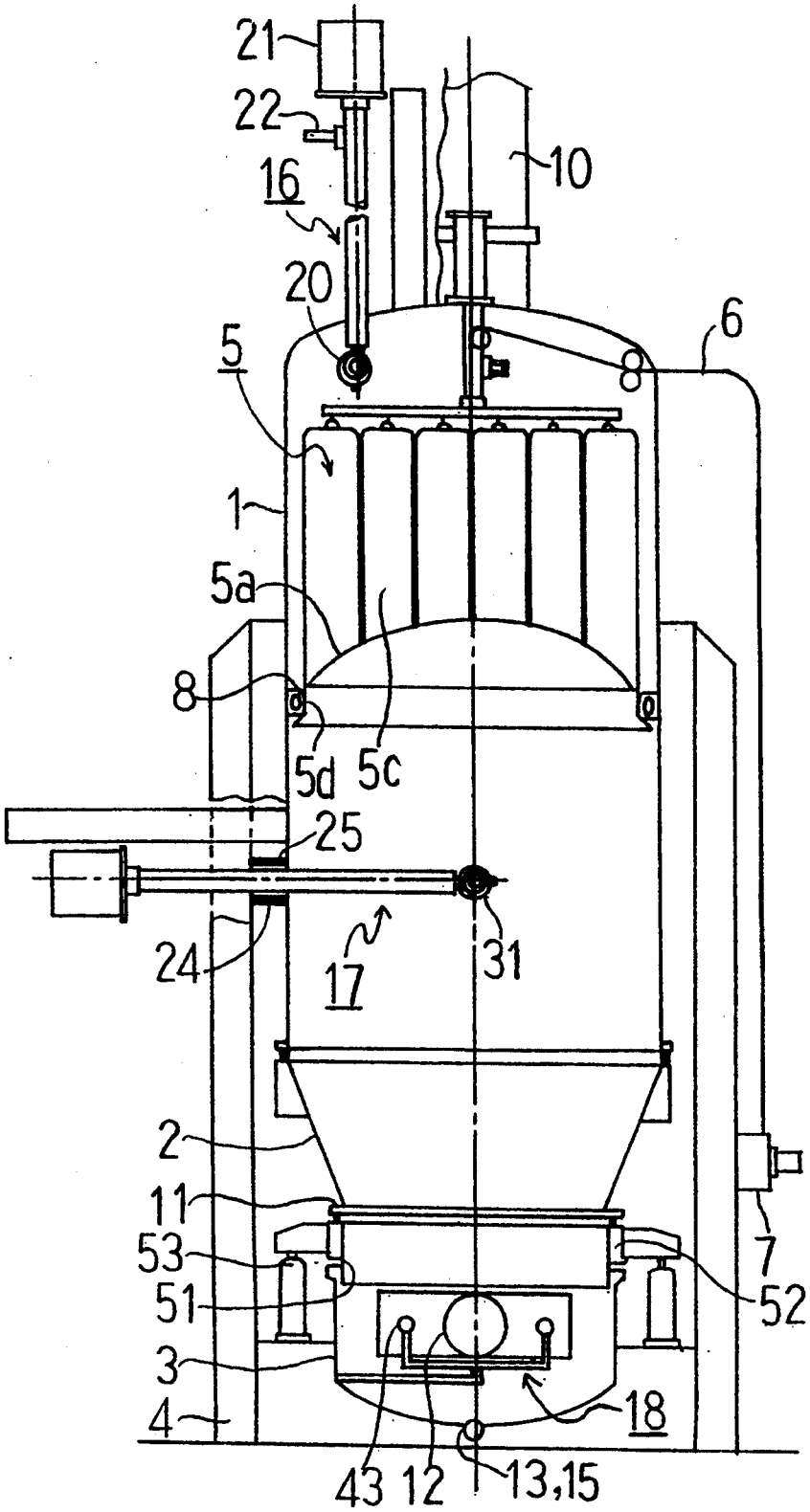
FIG. 1 is a front view, in section, of the present inventive apparatus, showing a bag filter as the latter is moving upward.
Figure 2:
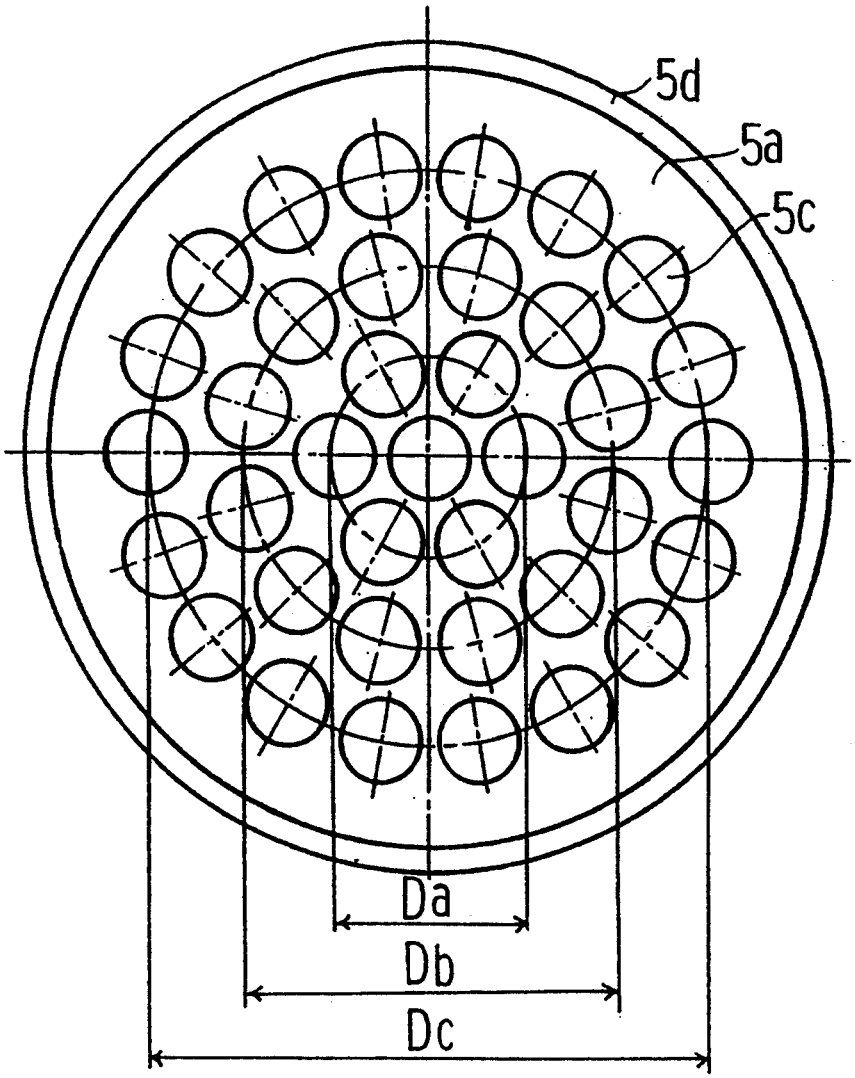
FIG. 2 is a plan view of the bag filter.
Figure 8:
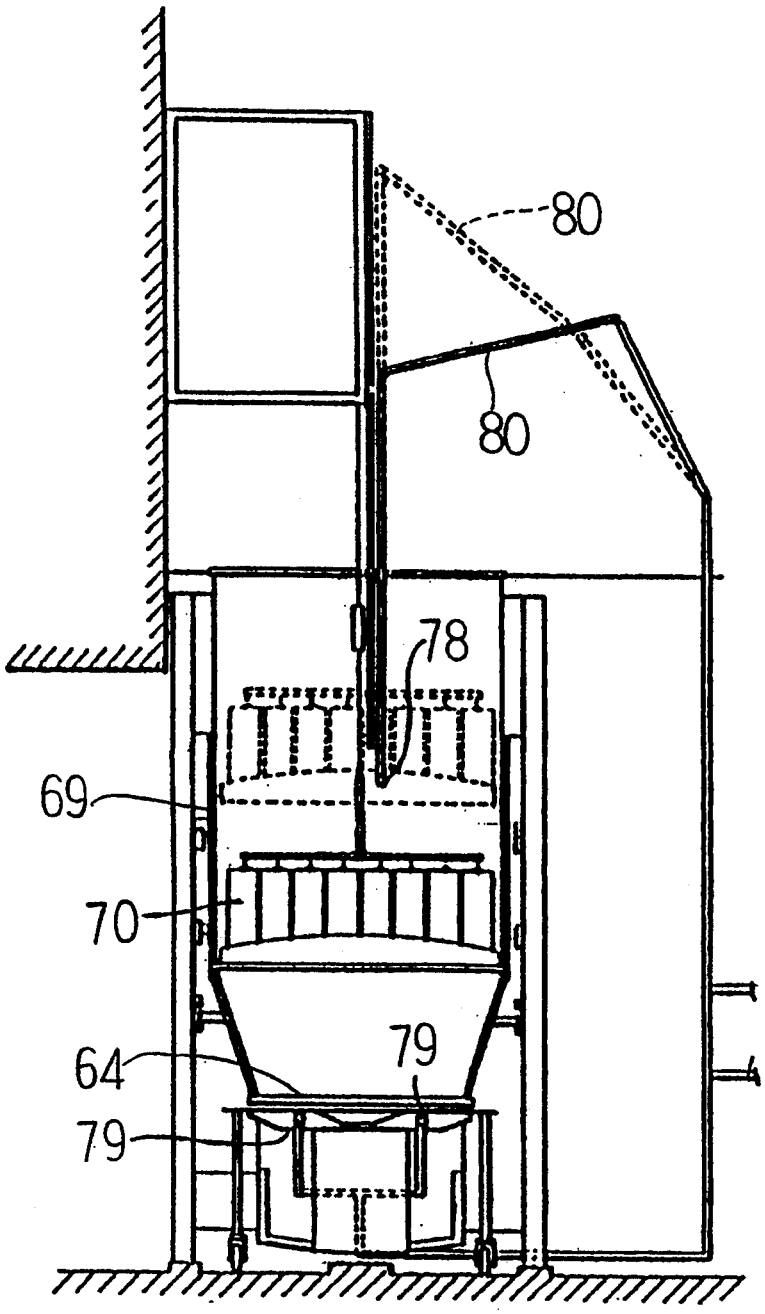
FIG. 8 is a sectional view showing a conventional washing apparatus for the fluidized bed pelletizing and drying machine.

The fluidized bed pelletizing and drying machine, as shown in FIG. 1, comprises cylindrical body 1, a frustoconical product container 2 with its diameter decreased toward the downward bottom, and a bottom section comprising a bottom container 3. The bottom container is fixed to a stationary member (not shown). The bottom container 3 is formed in the shape of a bowl or a funnel so as to be able to efficiently facilitate the discharge of spent washing liquid from a discharge port 13, and to facilitate uniformly blowing hot air into the body 1. After the fluidized particles are formed and dried according to the conventional use of this apparatus, a net unit 64 (see FIG. 8), suitably made of sintered metal, which has accumulated such particles therein, is suitably tipped over to discharge these particles into the bottom container 3. These particles are suitably discharged from the bottom container 3 through a port (not shown) in the bottom of the apparatus. The body 1 is fixedly supported at the lower region of its outer wall by body pillars 4, with a bag filter 5 suspended in the interior thereof. The bag filter 5 comprises a filter body 5*a* in the form of a bowl turned bottom down, filter elements 5*c* in the form of bottomed socks, and a skirt portion 5*d* with a flared lower portion. The filter elements 5*c*, as shown in a plan view in FIG. 2, are disposed in concentric circles having diameters of Da, Db and Dc and mounted on the filter body 5*a*. The bag filter 5 arranged in the manner described above is connected to a first lifting device 7 through a wire 6 so that it is vertically movable. On the other hand, an annular seal tire 8 is mounted on the inner surface of the body 1 at a position corresponding to the skirt portion 5*d*. The seal tire 8 has an annular space therein and it is arranged that fluid or gas is injected into and discharged from said space to inflate or contract the tire to decrease or increase the inner diameter thereof. This seal tire 8 is utilized such that when powder particles are treated, fluid is injected into said space to decrease the inner diameter until the tire closely contacts the skirt portion 5*d*. As a result, during treatment of powder particles, the air currents moving upward from the lower region of the body flow into the bag filter rather than passing through a clearance between the body 1 and the bag filter 5. An exhaust duct 10 for discharging the cleaned air resulting from removal of the solid particles is connected to the top of the body 1.

A sintered metal net unit 11 is mounted at the bottom of the product container 2, and an introducing pipe 12 for introducing a gas for fluidizing purposes is connected to the bottom container 3. Further, the bottom of the bottom container 3 is formed with a discharge port 13 communicating with a discharge pipe 15.

The arrangement of the washing apparatus for washing the fluidized bed pelletizing and drying machine arranged in the manner described above will now be described. This washing apparatus comprises such nozzle units as upright and horizontal three-dimensional rotary nozzle units 16 and 17, a rotary washing nozzle unit 18, and a multiple two-dimensional horizontal rotary nozzle unit 19, a washing container 23 having the same outer principal dimensions as those of the product container 2 and interchangeable with the latter, and a bearing unit 44 for removably supporting the product container 2 or washing container 23. In addition, during washing, the washing container 23 is mounted in place of the product container 2 between the body 1 and the bottom container 2.

The nozzle units 16 through 19 will be first described.

The upright three-dimensional nozzle unit 16 is connected to a second lifting mechanism (not shown), such as a cylinder, so that it is vertically movable, the nozzle unit 16 being mounted in the upper region of the body 1. This upright three-dimensional nozzle unit 16 has a spout nozzle 20 at its front end which performs three-dimensional motion as it performs planetary and rotary motions, and a nozzle rotation drive unit 21 at the other end. Further, it has a washing liquid supply port 22 at a predetermined position below the nozzle rotation drive unit 21.

The horizontal three-dimensional rotary nozzle unit 17 is mounted laterally of said body 1 and below the lifted position of the bag filter 5. This horizontal three-dimensional rotary nozzle unit 17 has the same arrangement as that of the upright three-dimensional rotary nozzle unit 16 and is movable horizontally between the inside and outside of the body 1. At its front end, it has a spout nozzle 31 which performs planetary and rotary motions. The lateral wall of the body 1 is formed with an opening 24 for receiving the horizontal three-dimensional rotary nozzle unit 17, and a pinch valve 25 is installed in said opening 24. The pinch valve 25 serves to close or open the opening 24 by having a fluid injected thereinto or discharged therefrom as in the case of the seal tire 8 described above. When the horizontal three-dimensional rotary nozzle unit 17 is moved into the body 1, the fluid is discharged to open the opening 24, but when it is moved out of the body 1, the fluid is injected thereinto to close the opening 24.

The rotary washing nozzle unit 18 is disposed inside the bottom container 3. The rotary nozzle unit 18 has spout nozzles 43 disposed at angularly equispaced positions inside the bottom container 3. The spout nozzles 43 spout the washing liquid in all directions while rotating. The same arrangement as this rotary nozzle unit 18 may be installed on the top of the body 1 (though not shown).

Figure 3:
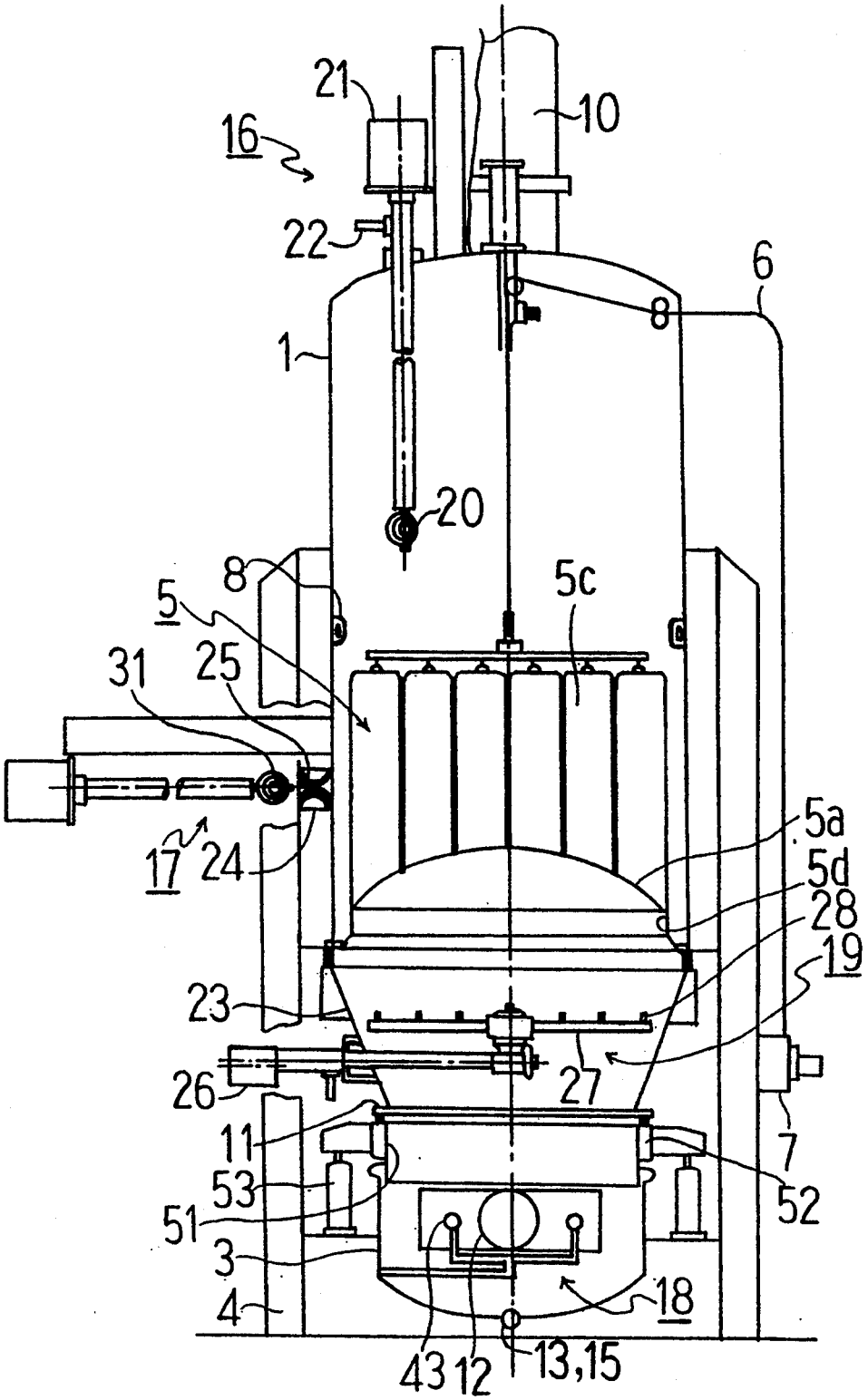
FIG. 3 is a front view, in section, of the present inventive apparatus, showing the bag filter as the latter is moving downward.
Figure 4:
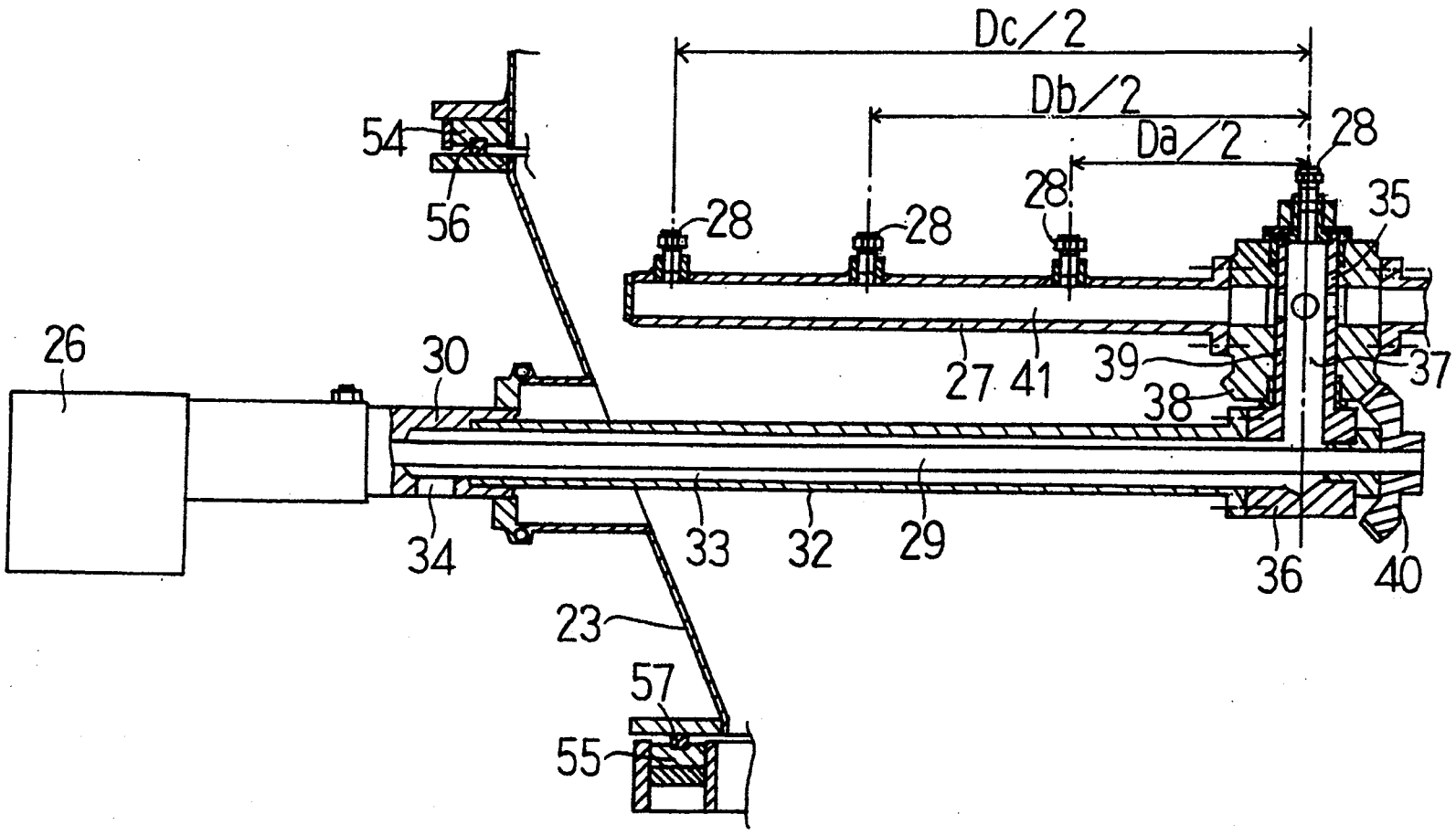
FIG. 4 is a sectional view of a washing container.

The multiple two-dimensional horizontal rotary nozzle unit 19, as shown in FIG. 3, is disposed in the washing container 23. The multiple two-dimensional rotary nozzle unit 19 is designed so that while rotating a nozzle header 27 by a geared motor 26, the washing liquid is spouted upward from a plurality of spout nozzles 28 mounted on the nozzle header 27. This arrangement will now be described with reference to FIG. 4. The output shaft (not shown) of the geared motor 26 disposed outside the washing container 23 is connected to a driving shaft 29 through a coupling (not shown). The driving shaft 29 extends through a lance housing 30 and then through a flanged lance 32 in the form of a pipe connected to said lance housing 30. The flanged lance 32 is internally formed with a water feed channel 33 which communicates with a liquid feed port 34 formed in the lance housing 30. A shaft-equipped housing 36 having an upwardly extending shaft portion 35 is attached to the flange of the flanged lance 32. The axis of the shaft portion 35 is in line with the assembly of the filter elements disposed in concentric circles. The shaft portion 35 is internally formed with a water feed channel 33. The shaft portion 35 rotatably receives a nozzle housing 39 having a bevel gear 38 formed on the lower end thereof. The bevel gear 38 meshes with a bevel gear 40 mounted on the front end of the drive shaft 29. On the other hand, the nozzle housing 39 has a plurality of hollow nozzle headers 27 horizontally attached thereto, and channels 41 in the nozzle headers 27 communicate with the water feed channel 37 in the shaft portion 35. The spout nozzles 28 are attached to the nozzle headers such that the radii of rotation of the spout nozzles are equal to the radii Da/2, Db/2, Dc/2 of concentric circles. With such arrangement, the washing liquid fed from the fluid feed port 34 flows through the feed channels 33 and 37 into the nozzle headers 27 rotating in a horizontal plane and is spouted upward from the spout nozzles 28.

addition, the supply of washing liquid to the nozzle units 16 through 19 is automatically controlled by a suitable control device.

As described above, in the washing apparatus according to the present invention, the upright three-dimensional rotary nozzle unit 16 capable of planetary and rotary motions is mounted on the top of the body 1. Therefore, washing liquid can be spouted at random in three-dimensional directions. Therefore, the inner surface of the body 1 and the outer surface of the bag filter 5 can be uniformly and reliably washed. On the other hand, since the horizontal three-dimensional rotary nozzle unit 17 also has a spout nozzle 31 of the same arrangement at the front end, the washing liquid is spouted at random in three-dimensional directions. Therefore, the inner surface of the bag filter and the lower region of the inner surface of the body 1 can be uniformly and reliably washed. Further, since the washing container 23 having the multiple two-dimensional horizontal rotary nozzle unit 19 is mounted between the body 1 and the bottom container 3, the inner surfaces of the filter elements 5*c* in the form of bottomed socks, which have heretofore been difficult to wash, can be reliably washed. That is, in the multiple two-dimensional horizontal rotary nozzle unit 19, since the spout nozzles 28 are disposed with radii of rotation equal to the radii of the concentric circles in which the filter elements 5*c* are disposed, the washing liquid reliably reaches the innermost regions of the filter elements 5*c*.

Figure 5:
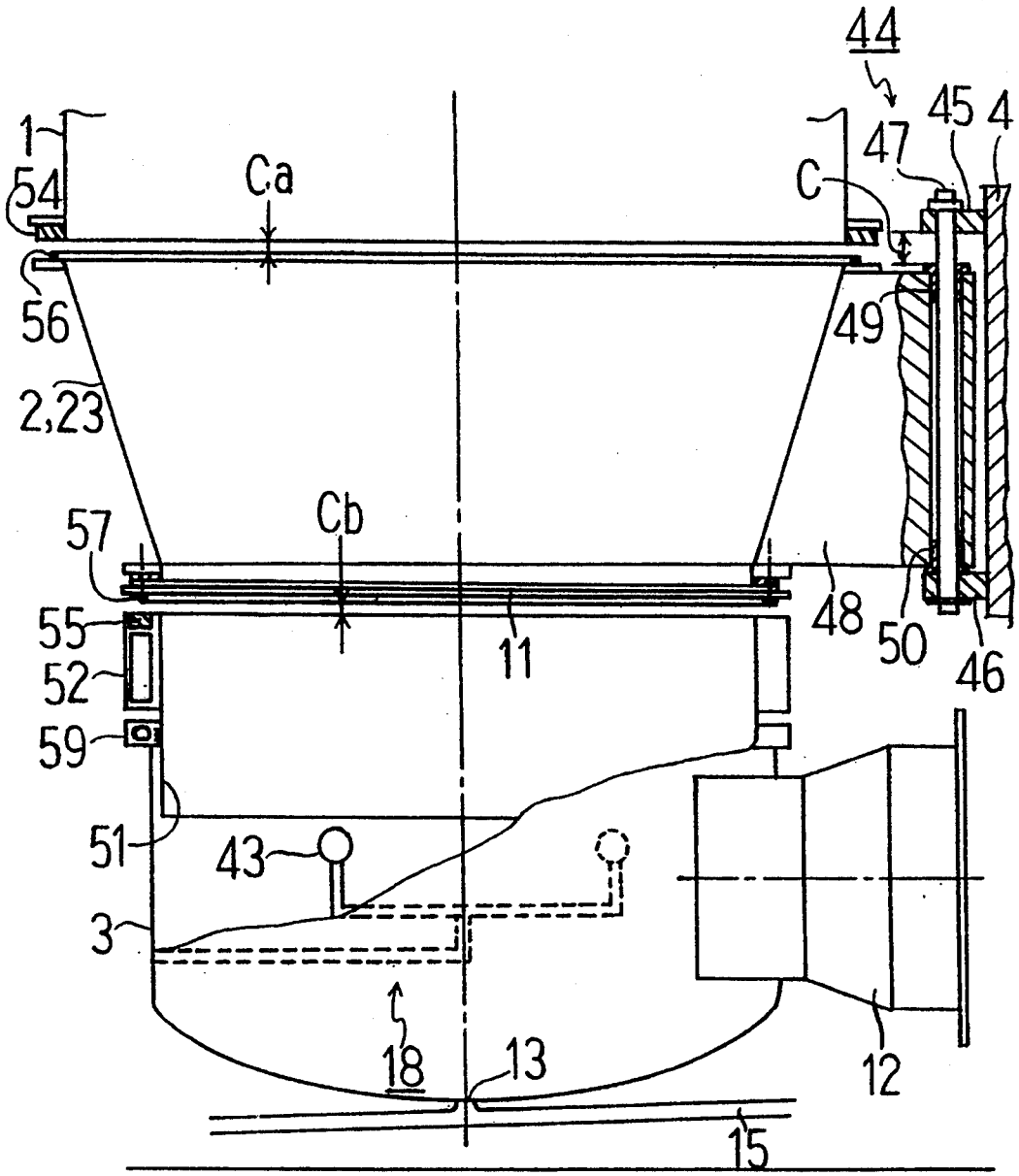
FIG. 5 is an enlarged view, partly in section, of the lower portion of a fluidized bed pelletizing and drying machine.

The arrangement of the bearing unit 44 will now be described with reference to FIG. 5. The bearing unit 44 comprises upper and lower brackets 45 and 46 fixed on the body pillar 4, a shaft set 47 inserted in said upper and lower brackets 45 and 46, and an arm 48 interconnecting the shaft set 47 and the product container 2. The arm 48 and shaft set 47 are connected by upper and lower bushes 49 and 50 fixed to the arm 48 and rotatably fitted on the shaft set 47, allowing the product container to swing around the shaft set 47. The lower bracket 46 is installed at a position such that when it is closely contacted with the lower bush 50, the clearance Ca between the body 1 and the product container 2 is equal to the clearance Cb between the product container 2 and the bottom container 3. On the other hand, the upper bracket 45 is installed at a position such that when the lower bracket 46 is closely contacted with the lower bush 50, the clearance C between the lower end surface of the upper bracket 45 and the upper end surface of the upper bush 49 is greater than said clearance Ca. With such arrangement, the product container 2 is allowed to move vertically through the distance equal to the clearance Ca. Further, the washing container 23 of the same arrangement as that of the product container 2 is mounted on the shaft set 47. At this time, the washing container 23 is mounted thereon in the same plane as that of the product container 2 while maintaining the same radius of rotation as that of the product container. With such arrangement, the product container 2 and the washing container 23 integrally perform swing movement around the axis of the shaft set 47. That is, either the product container 2 or the washing container 23 is selectively mounted between the body 1 and the bottom container 3. In addition, the values of the clearances C, Ca and Cb shown in FIG. 5 are maintained unchanged whether the product container 2 or the washing container 23 is selectively mounted.

On the other hand, a cylindrical slide guide 51 is fitted on the inner surface of the bottom container 3. This slide guide 51 has a push-up ring 52 mounted on the outer surface thereof, said push-up ring 52 being connected to cylinders 53 attached to a stationary member (not shown) outside the seat container. In addition, the numeral 59 denotes an annular seal packing for hermetically holding the slide guide 51.

Annular packings 54 and 55 are installed on the lower end of the body 1 and the upper end of the seat container 3. Annular packing glands 56 and 57 .are mounted on the upper and lower ends of the product container 2 and washing container 23.

in the above arrangement, the operation for change from the product container 2 to the washing container 23 is effected in the following procedure: First, with the body 1, product container 2, bottom container 3 held in close contact with each other, the control device (not shown) retracts the cylinders 53. Thereupon, the slide guide 51 moves downward and so does the product container 2. In this state, the shaft set 47 is rotated to discharge the product container outside and position the body 1 between the body 1 and the bottom container 3. When the control device (not shown) extends the cylinder 53, the slide guide 51 and washing container 23 move upward. In due course, the upper end of the washing container 23 abuts against the lower end of the body 1, with the result that the body 1, washing container 23, and bottom container 3 closely contact each other. In addition, the operation for change from the washing container to the product container 2 is performed in the same manner.

Thus, according to the arrangement and procedure described above, the operation for change between the product container 2 and the washing container 23 can be easily and reliably performed simply by rotating the shaft set 47.

Figure 6:
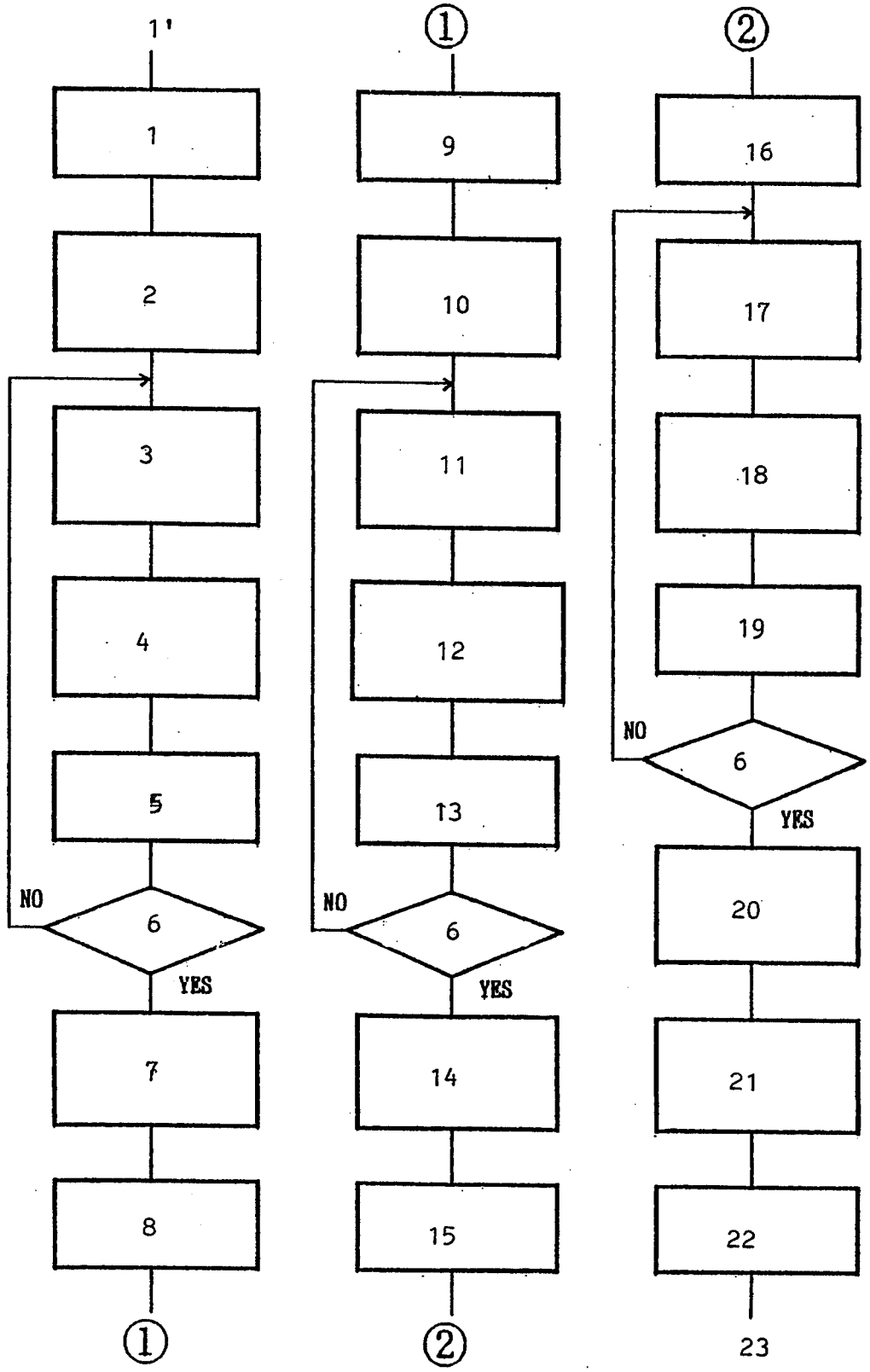
FIG. 6 is a flow chart showing a washing method using the present inventive apparatus.
Figure 7:
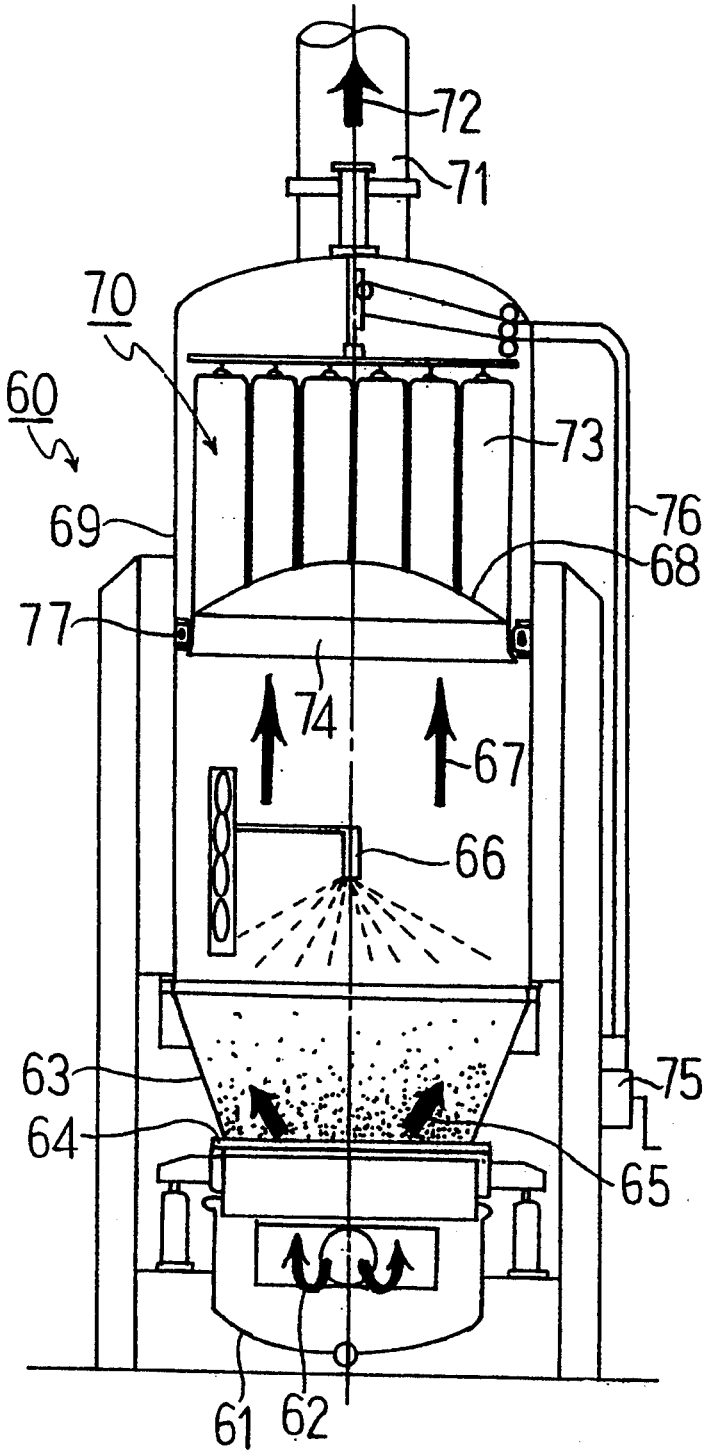
FIG. 7 is front view, in section, showing a conventional fluidized bed pelletizing and drying machine.

The washing operation using the washing apparatus for the fluidized bed pelletizing and drying machine is performed in the procedure shown in FIG. 5. This procedure is described below. The flow of the process depicted in FIG. 6 is briefly described as follows:

A. Start
B. Set the bag filter at its lifted position
C. Unclamp the seal tire bag filter
D. Wash with the upright three-dimensional rotary nozzle unit at its lifted position
E. Wash with the horizontal three-dimensional rotary nozzle unit at its advanced position
F. Wash with the rotary washing nozzle unit
G. Predetermined time of washing
H. Retract the horizontal three-dimensional rotary nozzle unit to its retracted position
I. Remove the product
J. Attach the washing container
K. Set the bag filter at its lowered position
L. Wash the upright three-dimensional rotary nozzle unit at its lowered position
M. Wash with the multiple two-dimensional horizontal rotary nozzle unit at the predetermined position
N. Wash with the rotary washing nozzle unit
O. Remove the washing container
P. Attach the product container
Q. Set the bag filter at its lifted position
R. Wash with the upright three-dimensional rotary nozzle unit at its lifted position
S. Wash with the horizontal three-dimensional rotary nozzle unit at its advanced position
T. Wash with the rotary washing nozzle unit
U. Retract the horizontal three-dimensional rotary nozzle unit to its retracted position
V. Clamp the seal tire bag filter
W. Hot air drying treatment
X. End In greater detail, this method is described as follows:

(1) During treatment of powder particles, the bag filter 5 is in its lifted position in the upper region of the body 1. Upon completion of treatment of powder particles, the fluid injected into the seal tire 8 is discharged outside, leaving the bag filter 5 unclamped.

(2) The upright three-dimensional rotary nozzle unit 16 is fixed in its lifted position and the horizontal three-dimensional rotary nozzle unit 17 is extended through the opening 24 into the body 1 (see FIG. 1).

(3) High temperature high pressure washing liquid is spouted from the spout nozzles 20, 28 and 43 of the upright three-dimensional rotary nozzle unit 16, horizontal three-dimensional rotary nozzle unit 17, and the rotary washing nozzle unit 18. At this time, the upright three-dimensional rotary nozzle unit 16 washes the upper region of the inner surface of the body and the outer surface of the bag filter 5. The horizontal three-dimensional rotary nozzle unit 17 washes the inner surface of the bag filter 5, the lower surface of the seal tire 8, the lower region of the inner surface of the body 1, the inner surface of the product container 2 and the upper surface of the sintered metal net unit 11. Further, the rotary washing nozzle unit 18 washes the inner surface of the bottom container 3 and the lower surface of the sintered metal net unit 11.

(4) Upon completion of predetermined time of washing operation, the horizontal three-dimensional rotary nozzle unit 17 is retracted to the outside of the body 1, whereupon the pinch valve 25 closes the opening 24. Further, the operator removes the product container 2 and attaches the washing container 23. Further, the bag filter 5 moves downward until it reaches a predetermined position, and then the upright three-dimensional rotary nozzle unit 16 moves downward (see FIG. 3).

(5) In this state, washing liquid is spouted from the spout nozzles 20, 28 and 43 of the upright three-dimensional rotary nozzle unit 16, multiple two-dimensional horizontal nozzle unit 19 and rotary washing nozzle unit 18, so as to perform washing operation. At this time, the upright three-dimensional rotary nozzle unit 16 washes the upper surface and inner lateral surface of the seal tire 8, the outer surface of the bag filter 5, and the upper region of the inner surface of the body 1. The multiple two-dimensional horizontal rotary nozzle unit 19 washes particularly the inner surface of the bag filter 5. The rotary washing nozzle unit 18 washes the inner surface of the bottom container 3, the lower surface of the sintered metal net unit 11 and the multiple two-dimensional horizontal rotary nozzle unit 19.

(6) Upon completion of predetermined time of washing operation, the washing container 23 is removed and the product container 2 is attached. The upright three-dimensional rotary nozzle unit 16 and the bag filter 5 move upward, returning to the state shown in FIG. 1.

(7) The horizontal three-dimensional rotary nozzle unit 17 moves to the advance position in the body 1, and washing is effected, as in the same manner as in the step (3), by the upright three-dimensional rotary nozzle unit 16, horizontal three-dimensional rotary nozzle unit 17 and rotary three-dimensional washing nozzle unit 18.

(8) Upon completion of predetermined time of washing operation, the horizontal three-dimensional nozzle unit 17 is retracted to the outside of the body 1 to close the opening 24.

(9) Fluid is injected into the seal tire 8 to decrease the inner diameter to clamp the bag filter 5. Further, hot air is blown through the introducing pipe 12 into the body 1 to dry the interior of the latter. In addition, the washing liquid used is discharged through the discharge pipe 15.

As has so far been described, according to the present invention, the bag filter 5 and the body 1 can be simultaneously washed without removing the bag filter from the body 1. Further, because of the provision of the upright and horizontal three-dimensional rotary nozzle units 16 and 17 which spout washing liquid at random in three-dimensional directions, the washing of the areas described above can be uniformly effected. Because of the provision of the multiple two-dimensional horizontal rotary nozzle unit 19, the inner surfaces of the filter elements 5c in the form of bottomed socks which have heretofore been difficult to wash can be reliably washed, Further, by performing the washing operation in the steps (1) through (9) described above, the inner surfaces of the body and product container 2 and the inner and outer surface of the bag filter 5 can be uniformly and reliably washed. Furthermore, such components of the fluidized bed pelletizing and drying machine as the inner surface of the bottom container 3, seal tire 8, sintered metal net unit 11 and multiple two-dimensional horizontal rotary unit 19 can also be washed. Therefore, according to the present invention, every parts of the fluidized bed pelletizing and drying machine can be uniformly and reliably washed.

What is claimed is:

1. A washing apparatus, for use in connection with a fluidized bed pelletizing and drying machine comprising a cylindrical body in which is housed a vertically movable bag filter comprising filter elements in the form of bottomed socks disposed in concentric circles, a seat container disposed in a lower region of said body, and a product container removably installed between said body and said seat container, said washing apparatus further comprising an upright three-dimensional rotary nozzle unit capable of vertically moving in a space above said bag filter, a horizontal three-dimensional rotary nozzle unit capable of horizontally advancing and retracting between a position in said body below an uppermost position of the said bag filter and a position outside said body, and a washing container in which is disposed a multiple two-dimensional horizontal rotary nozzle unit adapted to spout washing liquid in an Upwardly direction toward the inner surface of the said bag filter, wherein said washing container is detachably attached between said body and said seat container, and said washing container and said product container are selectively mounted between said body and said seat container such that during washing, the washing container is so attached and alternatively, during pelletizing treatment of powder particles, the product container is so attached.

2. A washing apparatus for a fluidized bed pelletizing and drying machine as set forth in claim 1, wherein the multiple two-dimensional horizontal rotary nozzle unit comprises a nozzle header rotatable in a horizontal plan and a plurality of spout nozzles mounted on said nozzle header, wherein the center of rotation of said nozzle header coincides with the center of the concentric circles defined by the filter elements of the bag filter, and wherein the radii of rotation of the spout nozzles correspond to the radii of the concentric circles.

3. A method of washing a fluidized bed pelletizing and drying machine employing a washing apparatus, said apparatus comprising:

a cylindrical body in which is housed a vertically movable bag filter comprising filter elements in the form of bottomed socks disposed in concentric circles, a seat container disposed in a lower region of said body, and a product container removably installed between said body and said seat container, and said apparatus for washing said machine comprising an upright three-dimensional rotary nozzle unit capable of vertically moving in a space above said bag filter, a horizontal three-dimensional rotary nozzle unit capable of horizontally advancing and retracting between a position in said body below an uppermost position of the said bag filter and a position outside said body, and a washing container in which is disposed a multiple two-dimensional horizontal rotary nozzle unit adapted to spout washing liquid from below toward the inner surface of the said bag filter.

wherein said washing container is detachably attached between said body and said seat container, and said washing container and said product container are selectively mounted between said body and said seat container such that during washing the washing container is so attached and alternatively during pelletizing treatment of powder particles, the product container is so attached.

said method comprising the steps of;

setting said bag filter at its upper position, spraying washing liquid from the upright and horizontal three-dimensional rotary nozzle units to effect initial washing of said machine, and upon completion of said initial washing, mounting the washing container in place of the product container between the body and the seat container;

moving the horizontal three-dimensional rotary nozzle unit to the outside of the body, lowering the bag filter and the upright three-dimensional rotary nozzle unit;

when the bag filter reaches its lower position, spraying washing liquid from the upright three-dimensional rotary nozzle unit and multiple two-dimensional horizontal rotary nozzle unit to effect final washing of said apparatus, upon completion of final washing of said apparatus, mounting the product container again in place of the washing container between the body and the seat container, returning the upright three-dimensional rotary nozzle unit and bag filter to their upper positions, and drying said apparatus with hot air.

* * * * *

UNITED STATES PATENT AND TRADEMARK OFFICE

CERTIFICATE OF CORRECTION

PATENT NO. : 5,336,332

DATED : August 9, 1995

INVENTOR(S) : Katsuhiko SATOH et al

It is certified that error appears in the above-identified patent and that said Letters Patent is hereby corrected as shown below:

On the cover page, Item [73], second line, change "Ariwa" to -- Arikawa --.

Signed and Sealed this

Twenty-second Day of August, 1995

*Attest:*

Bruce Lehman

BRUCE LEHMAN

*Attesting Officer*

*Commissioner of Patents and Trademarks*